US010036397B2

(12) United States Patent
Lewis et al.

(10) Patent No.: US 10,036,397 B2
(45) Date of Patent: Jul. 31, 2018

(54) DRAFT INDUCER BLOWER WHEEL HAVING IMPROVED SHAFT CONNECTION

(71) Applicant: Nidec Motor Corporation, St. Louis, MO (US)

(72) Inventors: William R. Lewis, Hazelwood, MO (US); L. Ranney Dohogne, Creve Coeur, MO (US); Marc J. Corcoran, St. Charles, MO (US); Matthew D. Allen, St. Peters, MO (US); Michael W. Major, Moro, IL (US)

(73) Assignee: Nidec Motor Corporation, St. Louis, MO (US)

( * ) Notice: Subject to any disclaimer, the term of this patent is extended or adjusted under 35 U.S.C. 154(b) by 503 days.

(21) Appl. No.: 14/679,838

(22) Filed: Apr. 6, 2015

(65) Prior Publication Data

US 2016/0290344 A1 Oct. 6, 2016

(51) Int. Cl.

| | |
|---|---|
| ***F04D 29/26*** | (2006.01) |
| ***F04D 29/02*** | (2006.01) |
| *F04D 29/62* | (2006.01) |
| *F04D 29/28* | (2006.01) |

(52) U.S. Cl.

CPC ..... *F04D 29/023* (2013.01); *F04D 29/263* (2013.01); *F04D 29/281* (2013.01); *F04D 29/282* (2013.01); *F04D 29/626* (2013.01); *F05D 2230/232* (2013.01); *F05D 2300/10* (2013.01); *F05D 2300/43* (2013.01); *Y10T 403/7026* (2015.01); *Y10T 403/7033* (2015.01); *Y10T 403/7035* (2015.01)

(58) Field of Classification Search

CPC .... F04D 29/263; F04D 29/281; F04D 29/282; F04D 29/626; Y10T 403/7026; Y10T 403/7033; Y10T 403/7035; F05B 2240/60; F05B 2260/30; F05B 2260/303

USPC ..... 416/244 R

See application file for complete search history.

(56) References Cited

U.S. PATENT DOCUMENTS

| | | | | |
|---|---|---|---|---|
| 4,763,031 A * | 8/1988 | Wang | F16H 1/28 310/112 |
| 5,938,405 A * | 8/1999 | Coleman | F01P 5/04 416/169 A |
| 9,206,825 B2 * | 12/2015 | Lei | F16B 7/18 |

FOREIGN PATENT DOCUMENTS

JP 62251522 A * 11/1987

OTHER PUBLICATIONS

JP 62251522—Original and translation from Espacenet.*

* cited by examiner

*Primary Examiner* — Justin Seabe
*Assistant Examiner* — Behnoush Haghighian
(74) *Attorney, Agent, or Firm* — Hovey Williams LLP

(57) ABSTRACT

A blower motor assembly includes a blower wheel and a motor. The blower wheel includes an integrally formed hub. The motor includes a shaft rotatable about an axis. The hub presents a radially inner hub surface that at least in part defines a hub opening. The inner hub surface defines an inner cross-sectional dimension. The shaft is axially received within the hub opening, such that the blower wheel is supported by the shaft for rotational movement. The shaft includes a toothed region defining a plurality of arcuately spaced apart teeth. Each of the teeth includes a cutting edge. The teeth present an outer cross-sectional dimension that is great than the inner cross-sectional dimension of the inner hub surface, such that the cutting edges of the teeth cut a plurality of grooves in the inner hub surface as the shaft is axially received in the hub opening.

19 Claims, 17 Drawing Sheets

DRAFT INDUCER BLOWER WHEEL HAVING IMPROVED SHAFT CONNECTION

BACKGROUND OF THE INVENTION

1. Field of the Invention

The present invention relates generally to a blower wheel and shaft assembly for use in a high-efficiency furnace or other application.

2. Discussion of the Prior Art

Those of ordinary skill in the art will appreciate that a secure interconnection between a shaft and the structure or structures it supports is conventionally desirable. In the case of a rotatable shaft and blower wheel in a high-efficiency furnace, for instance, interconnection of the shaft and blower wheel is conventionally facilitated by means of a metal insert that is overmolded into the plastic blower wheel and then coupled to the metal shaft via an interference fit (i.e., press fit) such that the shaft and blower wheel are simultaneously rotatable.

SUMMARY

According to one aspect of the present invention, a blower motor assembly is provided for use in a machine. The motor assembly comprises a blower wheel including an integrally formed hub and a motor including a shaft rotatable about an axis. The hub presents a radially inner hub surface that at least in part defines a hub opening. The inner hub surface defines an inner cross-sectional dimension. The shaft is axially received within the hub opening, such that the blower wheel is supported by the shaft for rotational movement. The shaft includes a toothed region defining a plurality of arcuately spaced apart teeth. Each of the teeth includes a cutting edge. The teeth present an outer cross-sectional dimension that is great than the inner cross-sectional dimension of the inner hub surface, such that the cutting edges of the teeth cut a plurality of grooves in the inner hub surface as the shaft is axially received in the hub opening.

This summary is provided to introduce a selection of concepts in a simplified form. These concepts are further described below in the detailed description of the preferred embodiments. This summary is not intended to identify key features or essential features of the claimed subject matter, nor is it intended to be used to limit the scope of the claimed subject matter.

Various other aspects and advantages of the present invention will be apparent from the following detailed description of the preferred embodiments and the accompanying drawing figures.

BRIEF DESCRIPTION OF THE DRAWING FIGURES

Preferred embodiments of the present invention are described in detail below with reference to the attached drawing figures, wherein.

Figure 1:
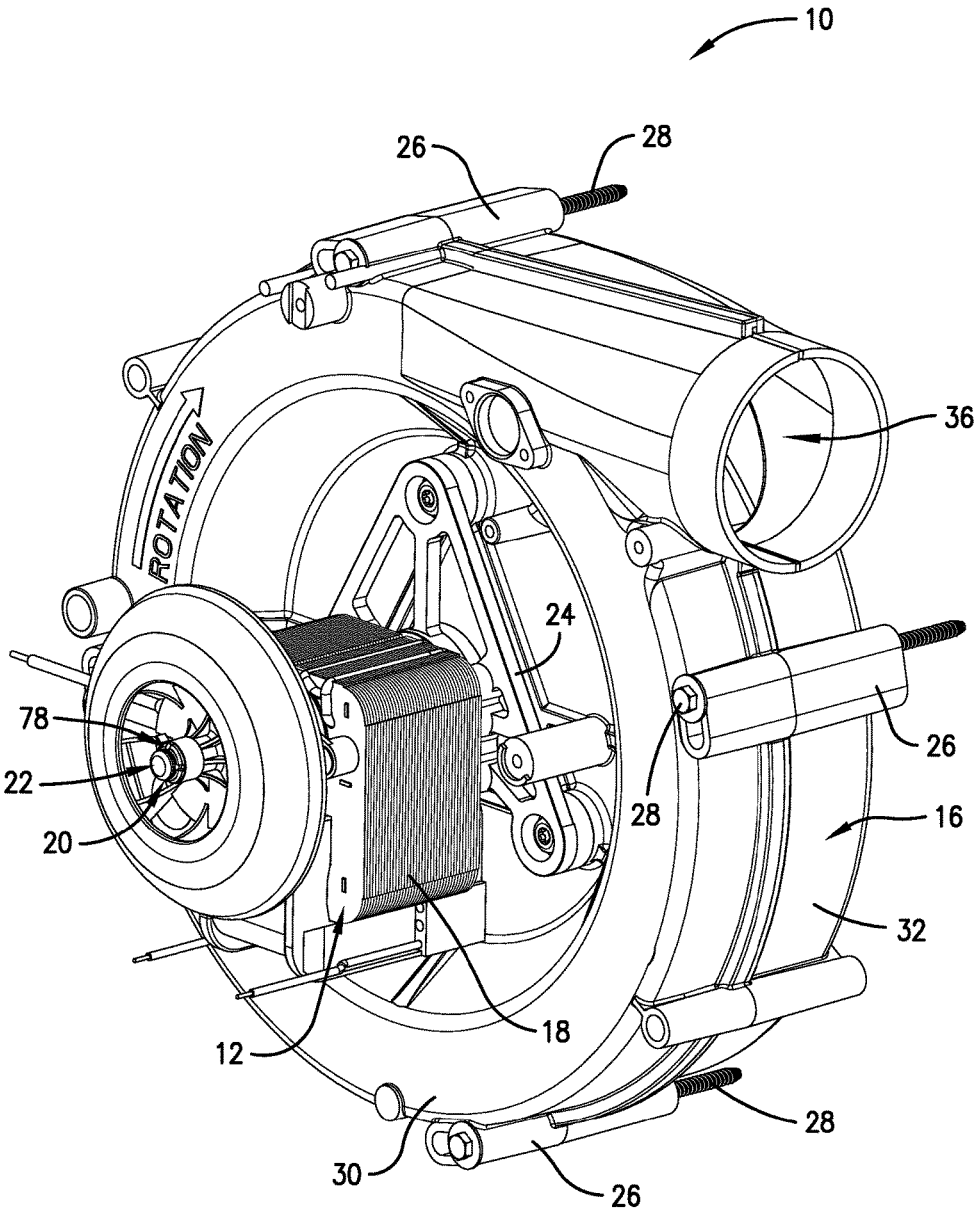
FIG. 1 is a front perspective view of a blower motor assembly constructed in accordance with a first preferred embodiment of the present invention.

The drawing figures do not limit the present invention to the specific embodiments disclosed and described herein. The drawings are not necessarily to scale, emphasis instead being placed upon clearly illustrating the principles of the preferred embodiments.

Furthermore, directional references (e.g., top, bottom, front, back, side, etc.) are used herein solely for the sake of convenience and should be understood only in relation to each other. For instance, a component might in practice be oriented such that faces referred to as "top" and "bottom" are sideways, angled, inverted, etc. relative to the chosen frame of reference.

DETAILED DESCRIPTION OF THE PREFERRED EMBODIMENTS

The present invention is susceptible of embodiment in many different forms. While the drawings illustrate, and the specification describes, certain preferred embodiments of the invention, it is to be understood that such disclosure is by way of example only. There is no intent to limit the principles of the present invention to the particular disclosed embodiments.

Figure 2:
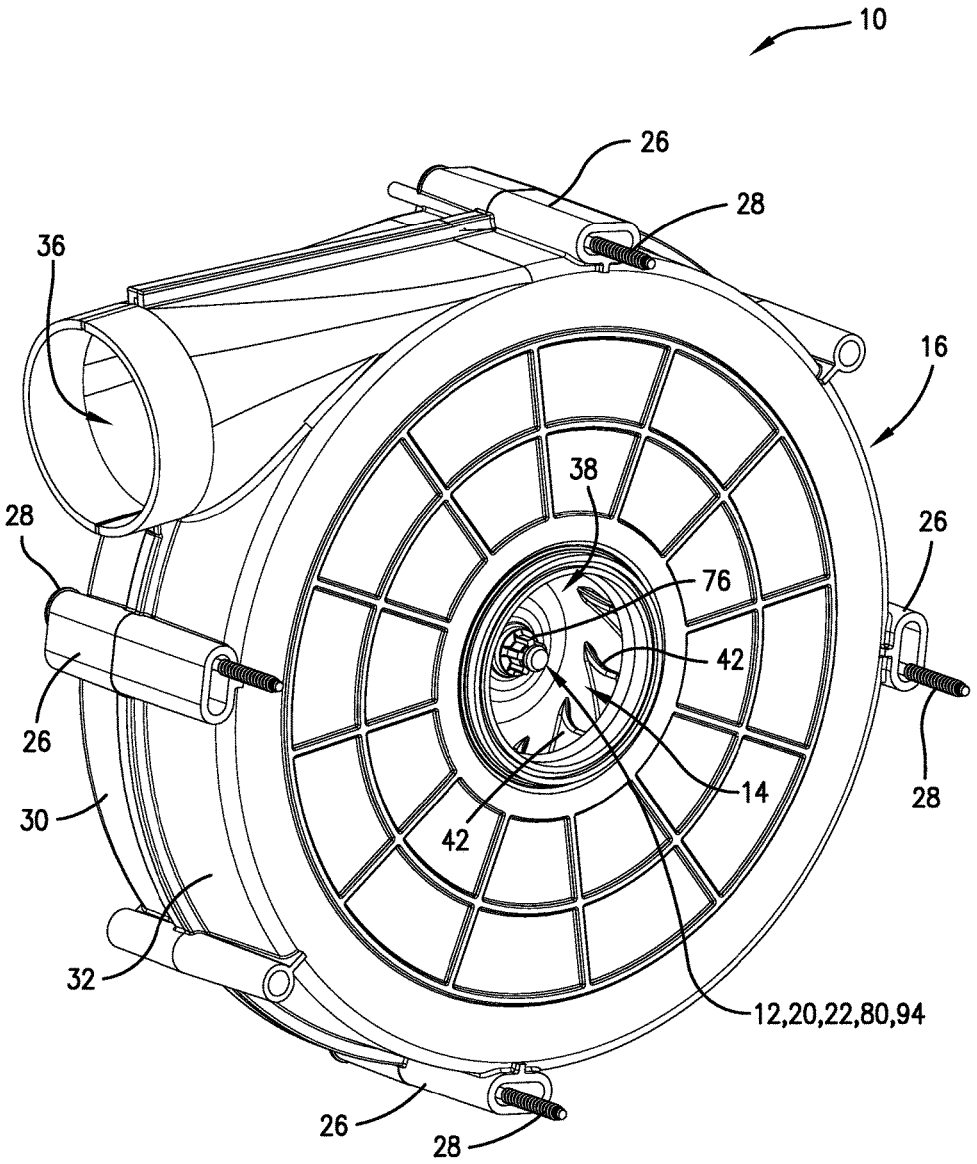
FIG. 2 is a rear perspective view of the blower motor assembly of FIG. 1.
Figure 3:
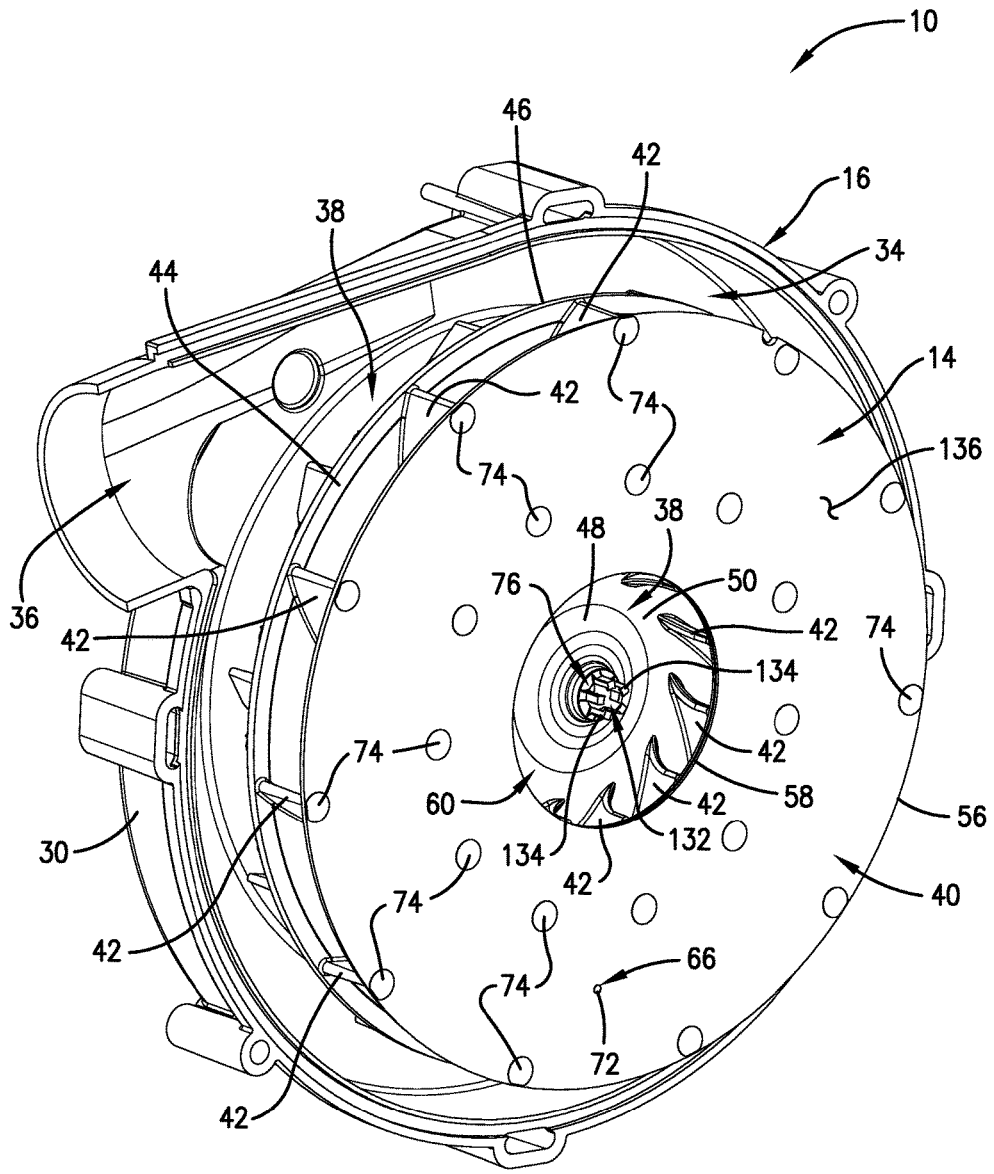
FIG. 3 is a partially sectioned rear perspective view of the blower motor assembly of FIGS. 1 and 2, particularly illustrating the disposition of the blower wheel in the wheel chamber defined by the housing.

With initial reference to FIGS. 1-3, a blower motor assembly 10 is illustrated. The blower motor assembly 10 preferably includes a blower motor 12, a blower wheel 14, and a housing 16.

The blower motor 12 preferably includes a stator 18 and a rotor 20 rotatable about an axis. The rotor 20 preferably includes a shaft 22 rotatable about an axis. The blower wheel 14 is preferably supported by the shaft 22 for rotational movement therewith. In a preferred embodiment, the motor 12 is operable to rotate the shaft 22, which in turn rotates the blower wheel 14. The blower wheel 14 generates airflow that is directed by the housing 16.

The principles of the present invention are equally applicable to the blower wheel 14 being supported by a shaft other than the rotor shaft 22, as illustrated. For example, the motor may alternatively be provided with an output shaft which is drivingly connected to the rotor shaft, with the blower wheel being supported on the output shaft. A transmission may also be provided, if desired, with the blower wheel being alternatively supported on one of the shafts of the transmission.

The motor 12 is preferably an induction motor but may be of any type known in the art without departing from the scope of the present invention. For instance, the motor might alternatively be a brushless permanent magnet motor.

Most preferably, the blower wheel 14 is a draft inducer blower wheel and the blower motor 12 is for use in a high-efficiency furnace. Other applications are permissible, however.

The motor 12 is preferably secured on the housing 16 by means of a mounting bracket 24, shown in FIG. 1. Other mounting means are permissible, however.

The housing 16 preferably includes a plurality of mounting bosses 26 through which fasteners 28 extend for securing the entire blower motor assembly 10 to a machine (not shown). The machine is preferably a high-efficiency furnace, although other machines are permissible.

The housing 16 preferably includes first and second halves 30 and 32, respectively, although an integrally formed housing or one comprising more than two (2) segments may be provided without departing from the scope of the present invention.

The housing 16 preferably defines a cylindrical wheel chamber 34 and an outlet 36 fluidly interconnected with the wheel chamber 34. The wheel chamber 34 preferably receives the blower wheel 14. The outlet 36 preferably extends generally tangentially relative to the wheel chamber 34. Other housing forms are permissible, however. For instance, the wheel chamber might alternatively be generally cuboidal or include an additional outlet.

As best shown in FIGS. 3-7, the blower wheel 14 preferably includes a front plate 38 and a rear plate 40. The front and rear plates 38 and 40, respectively, are axially spaced apart and interconnected by a plurality of generally radially extending, arcuately spaced apart vanes 42. The front plate 38, the rear plate 40, and the vanes 42 will be discussed in greater detail below.

The blower wheel 14 preferably comprises a plastic or synthetic resin material, although the use of one or more other materials is permissible according to some aspects of the present invention. More particularly, as will be discussed in greater detail below, specific materials are of less importance than the relative properties of the material(s) constituting certain regions of the blower wheel 14 and the shaft 22.

Preferably, the blower wheel 14 is formed by one or more molding processes (e.g., one molding process for formation of the front plate 38 and one molding process for formation of the rear plate 40). However, use of additional or alternative processes (e.g., machining and/or stamping, as might be required if some of all of the blower wheel were formed of metal) is permissible according to some aspects of the present invention.

Figure 4:
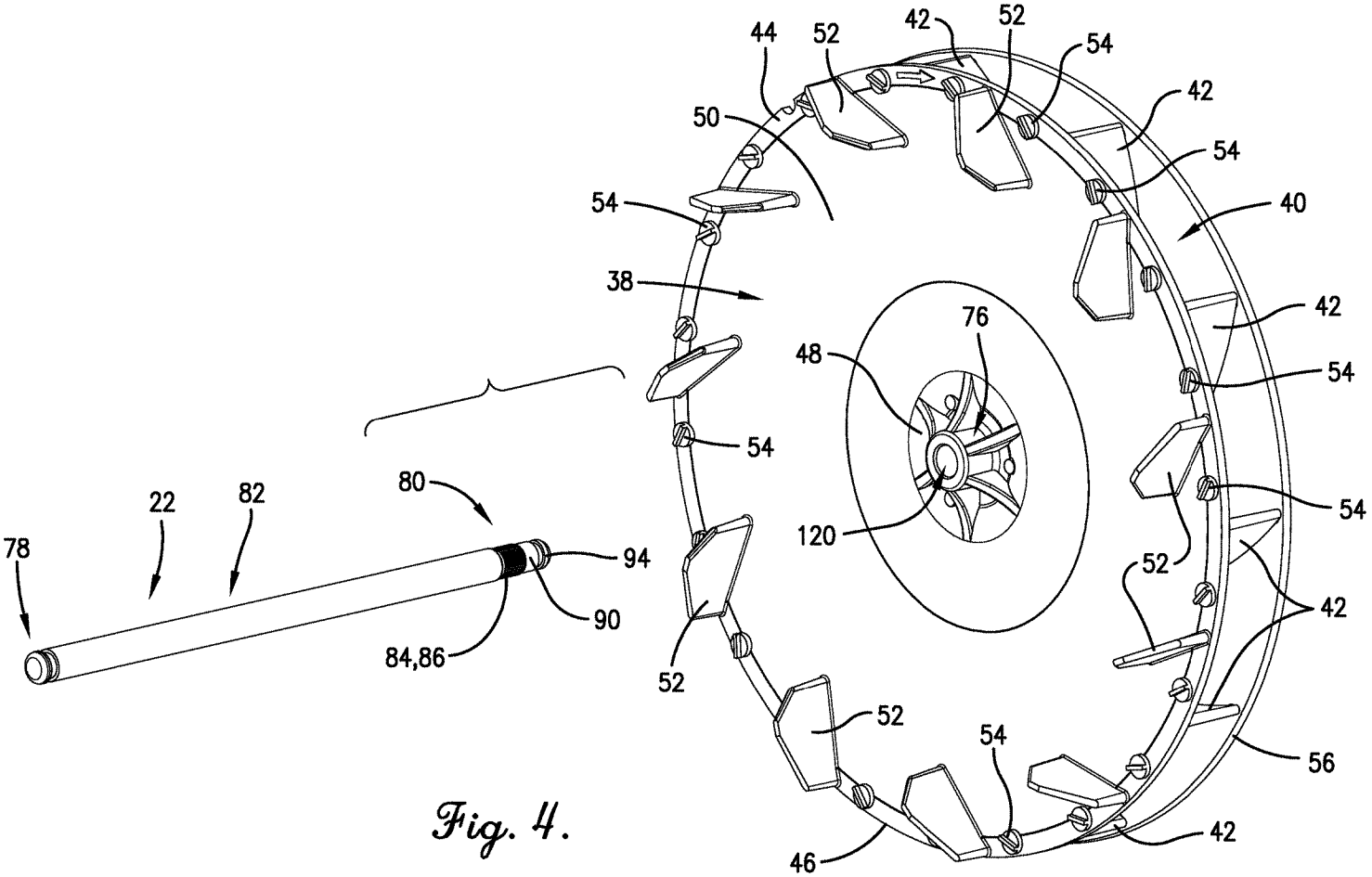
FIG. 4 is an exploded front perspective view of the shaft and blower wheel of the blower motor assembly of FIGS. 1-3.

As illustrated in FIG. 4 and others, the front plate 38 preferably includes an outer rim region 44 defining a radially outermost margin 46 of the front plate 38; an inner hub region 48; and intermediate region 50 extending between and interconnecting the rim and hub regions 44 and 48, respectively. In a preferred embodiment, as shown, the rim, hub, and intermediate regions 44, 48, and 50, respectively, are all integrally formed with each other. It is permissible according to some aspects of the present invention, however, for one or more of the regions to be non-integrally formed.

In a preferred embodiment, a plurality of arcuately spaced apart, generally radially extending blades 52 project axially outwardly from the front plate 38, away from the vanes 42 and the rear plate 40. The blades are preferably evenly arcuately spaced apart, although uneven spacing is permissible.

Each blade 52 preferably extends from a location in the intermediate region 50 to a location at or near the radially outermost margin 46 of the front plate 38. It is permissible, however, for the blades to be alternatively positioned (e.g., nearer the hub region than the rim region).

The blades 52 are preferably integrally formed with the front plate 38, although non-integral configurations are permissible. For instance, the blades might alternatively snap into place or be fastened or adhered to the front plate.

As best shown in FIG. 4, a plurality of arcuately spaced apart balancing nubs 54 extend generally axially outwardly from the front plate 38. The balancing nubs 54 are preferably evenly arcuately spaced apart, although uneven and/or non-arcuate spacing is permissible. Furthermore, although the balancing nubs 54 are preferably provided at the rim region 44, adjacent the radially outermost margin 46, alternative radial positioning is permissible as well.

The front plate 38 is preferably formed in a molding process that includes formation of the balancing nubs 54, with the axial height of each nub 54 varying depending on the position of a corresponding balancing screw or other shiftable structure in the mold itself during the process. For instance, if a given balancing screw is turned so as to shift the screw axially inwardly prior to molding, the resulting molded balancing nub will have a smaller axial height. In contrast, if the balancing screw is turned so as to shift the screw axially outwardly prior to molding, the balancing nub 54 will have a greater axial height. The heights of the nubs are preferably varied as necessary to ensure the blower wheel 14 as a whole is balanced upon removal from the mold. That is, material removal and/or other post-molding procedures are preferably not required for production of a balanced blower wheel, with the molding process alone preferably being sufficient.

Although provision of balancing nubs 54 as described above is preferred, it is permissible according to some aspects of the present invention for alternative or additional means of balancing to be provided and/or utilized, including but not limited to post-molding material removal processes.

As best shown in FIGS. 3 and 5-7, the rear plate 40 preferably has a toroidal form so as to present a radially outermost margin 56 and a radially innermost margin 58. The radially innermost margin 58 preferably defines a central opening 60.

The rear plate 40 preferably defines a plurality of radially inner connecting pin openings 62 and a plurality of radially outer connecting pin openings 64. The respective pluralities of inner and outer connecting pin openings 62 and 64 are preferably evenly arcuately spaced apart, although uneven and/or non-arcuate spacing of either or both pluralities of openings is permissible according to some aspects of the present invention. Furthermore, alternative groupings or arrangements (i.e., non-radially-based groupings) or no groupings or arrangements at all (e.g., an even distribution or a random distribution) are permissible according to some aspects of the present invention. The connecting pin openings 62 and 64 will be discussed in greater detail below.

The rear plate 40 further preferably defines a locating hole 66. The locating hole 66 will also be discussed in greater detail below.

Figure 7:
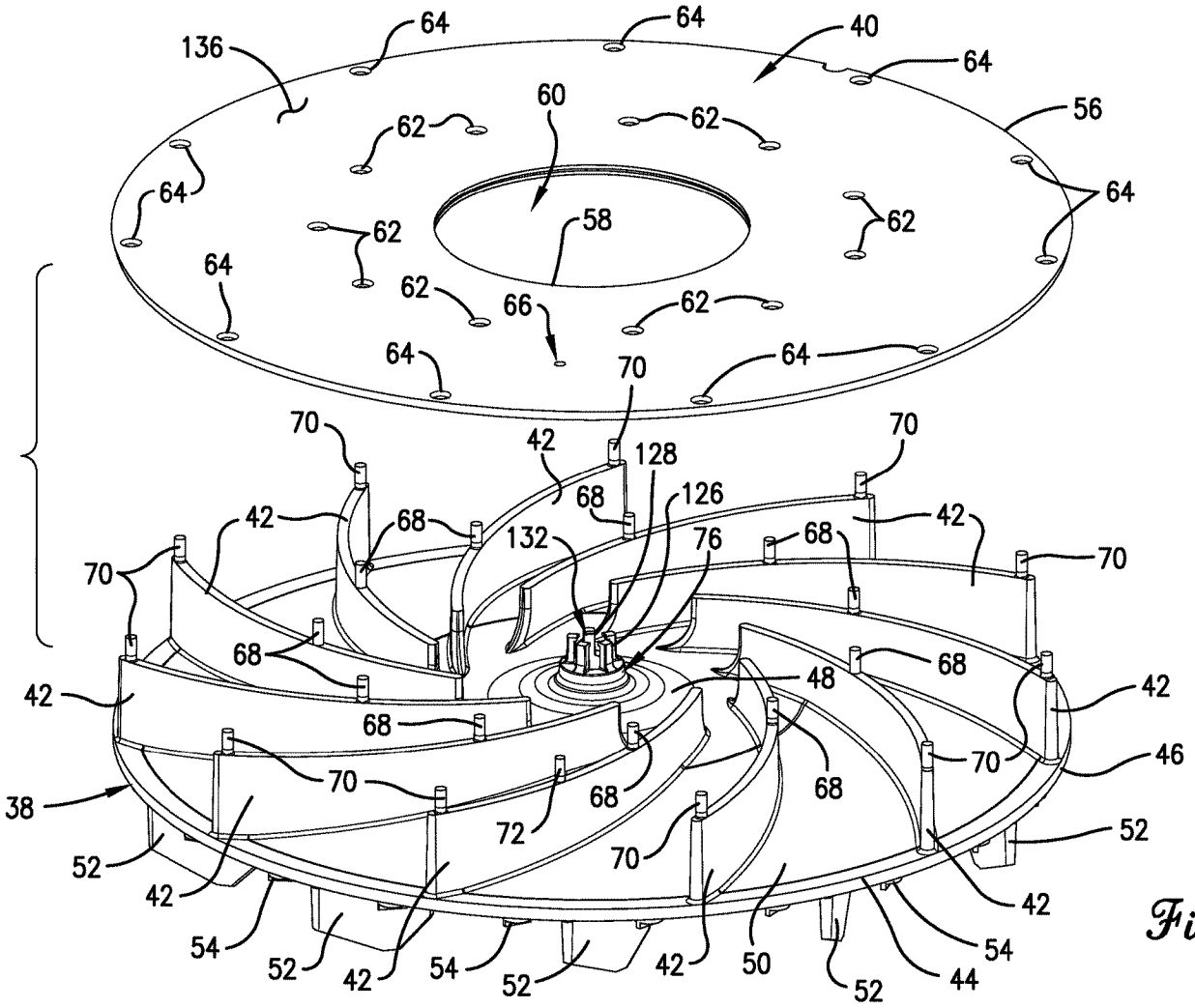
FIG. 7 is a perspective view of the blower wheel of FIGS. 2-6, with the rear plate elevated, particularly illustrating the positioning pegs prior to joining of the rear plate and the pegs via ultrasonic welding.

As noted previously, the front and rear plates 38 and 40, respectively, are preferably axially spaced apart and interconnected by the generally radially extending, arcuately spaced apart vanes 42. As best shown in FIG. 7, in which the rear plate 40 has been elevated, the vanes 42 preferably project axially from the front plate 38 and are evenly arcuately spaced apart, although uneven spacing is permissible according to some aspects of the present invention. Furthermore, some or all of the vanes could projected from the rear plate in an alternative embodiment.

Preferably, each vane extends from a location in the hub region 48 to a location at or near the radially outermost margin 46. However, it is permissible for some or all of the vanes to extend a different degree. For instance, alternating ones of the vanes might instead extend from a location in the intermediate region to a location at or near the radially outermost margin.

In a preferred embodiment, the vanes 42 are curved for aerodynamic optimization. That is, each vane 42 is generally radially extending (as noted previously) but also includes some degree of circumferential extension so as to extend both radially and circumferentially. However, it is permissible for straight or otherwise configured vanes to be provided without departing from the scope of the present invention.

Furthermore, although it is preferred that each of the vanes 42 be identically shaped and sized, variations are permissible. For instance, alternating ones of the vanes could be curved more or less than the others, or some of the vanes could extend a shorter distance.

The vanes 42 are preferably integrally formed with the front plate 38, although non-integral interconnection (e.g., by means of fasteners and/or adhesives) is permissible according to some aspects of the present invention.

As best shown in FIG. 7, the blower wheel 14 preferably includes a plurality of radially inner connecting pins 68 and a plurality of radially outer connecting pins 70, wherein corresponding pairs of the inner and outer connecting pins preferably project axially from respective vanes 42 toward the rear plate 40. The inner connecting pins 68 preferably correspond with the inner connecting pin openings 62 formed in the rear plate 40, while the outer connecting pins 70 preferably correspond with the outer connecting pin openings 64 formed in the rear plate 40.

In keeping with the alternative arrangements discussed above with regard to the connecting pin openings 62 and 64, alternative groupings or arrangements (i.e., non-radially-based groupings) or no groupings or arrangements at all (e.g., an even distribution or a random distribution) of the pins are permissible according to some aspects of the present invention. Preferably, however, the pins and openings correspond to each other to at least some extent.

Referring again to FIG. 7, a locating pin 72 preferably extends from one the vanes 42. The locating pin 72 is preferably positioned intermediately between the inner and outer connecting pins 68 and 70 on the corresponding vane 42, although alternate methods of relative positioning are permissible. Furthermore, it is permissible according to some aspects of the present invention for the locating pin to be disassociated from the vanes. For instance, the locating pin could instead extend directly from the front plate.

As noted previously, the rear plate 40 preferably defines a locating hole 66. Alignment of the locating pin 72 and the locating hole 66 during the assembly process enables efficient subsequent alignment of the connecting pins 68 and 70 with the corresponding connecting pin openings 62 and 64 (see FIG. 7).

Alternative means of appropriately orienting the rear plate are permissible without departing from the scope of some aspects of the present invention, however.

Figure 5:
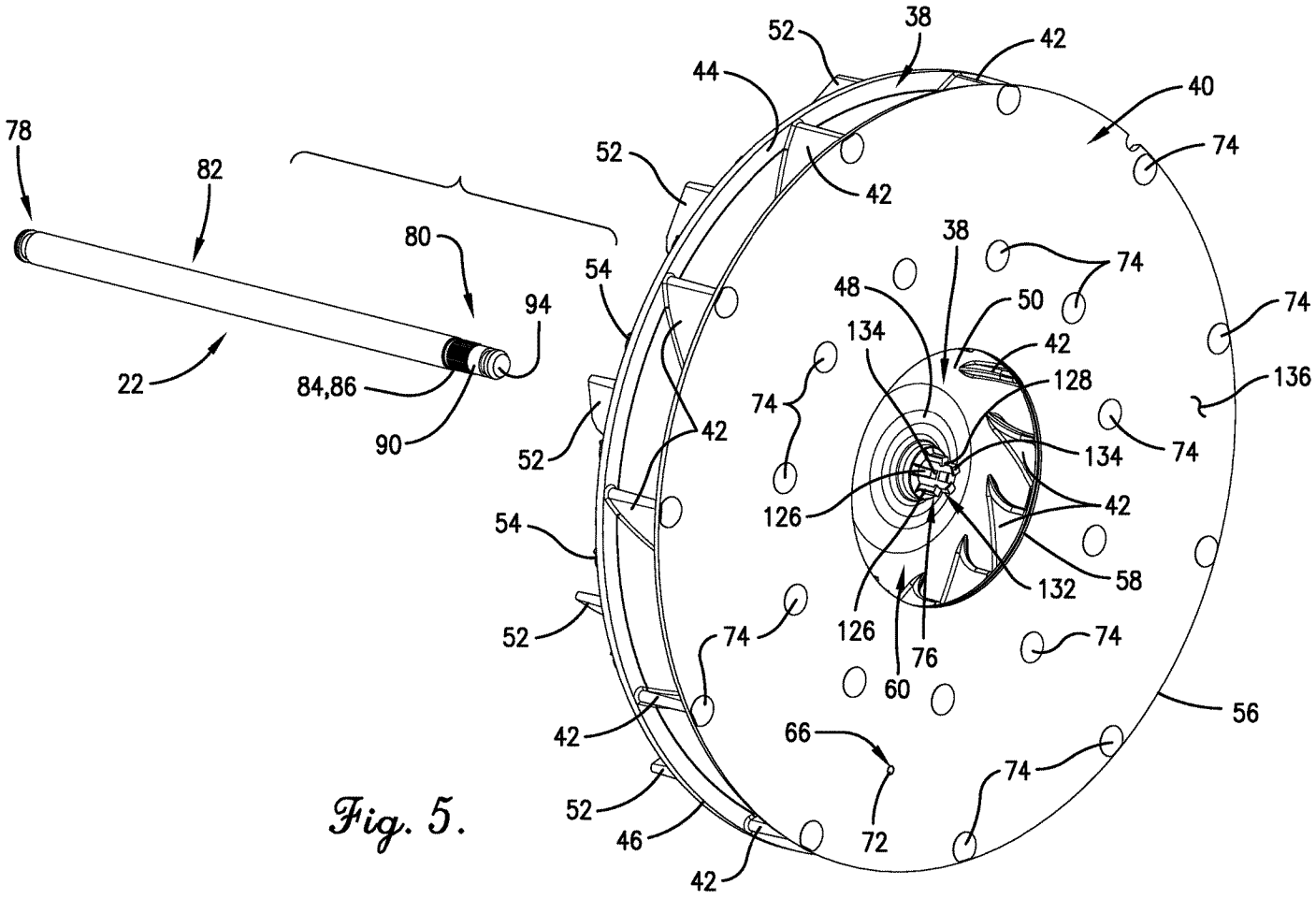
FIG. 5 is an exploded rear perspective view of the shaft and blower wheel of FIG. 4.
Figure 6:
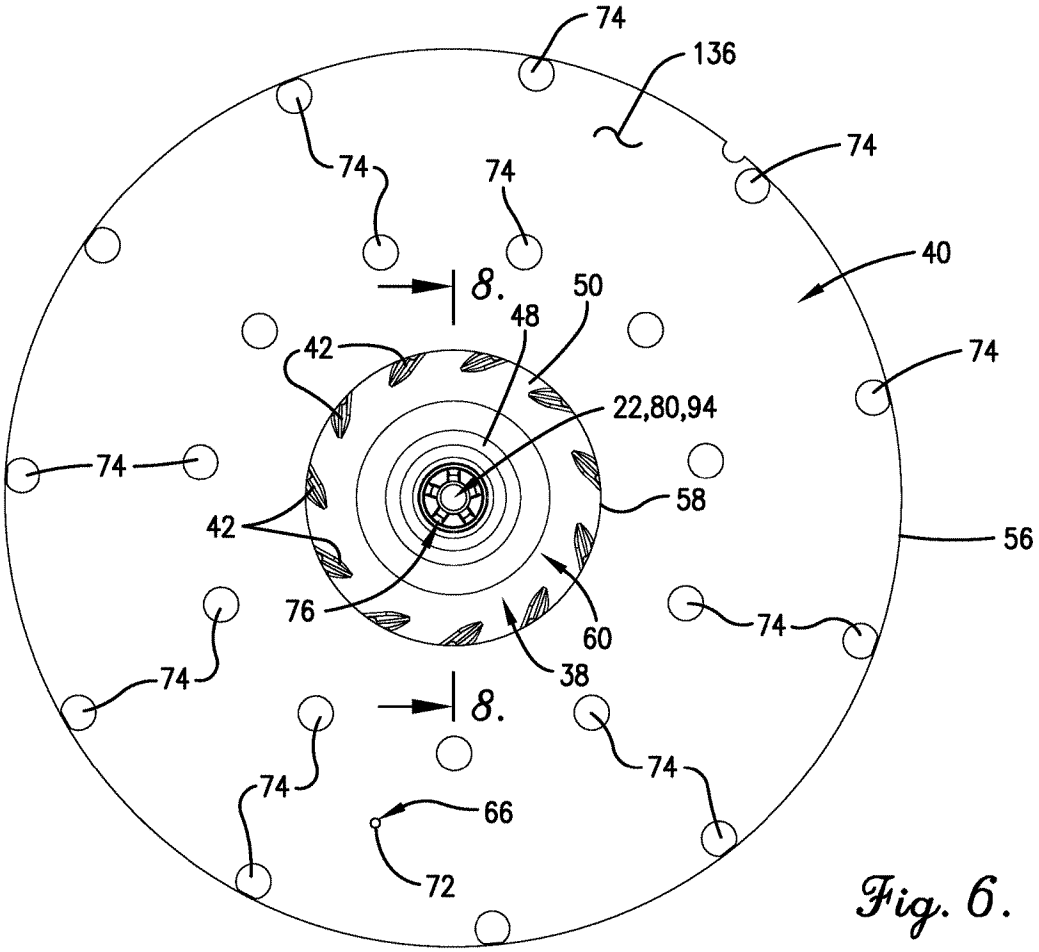
FIG. 6 is a rear view of the shaft and blower wheel of FIGS. 4 and 5.

As best shown in FIGS. 3, 5, and 6, during assembly of the blower wheel 14, the locating pin 72 is preferably received in the locating hole 66. Similarly, the connecting pins 68 and 70 are preferably received in the connecting pin openings 62 and 64. The connecting pins 68 and 70 are then ultrasonically welded into place so as to form corresponding weld regions 74. The welding process preferably secures the rear plate 40 onto the vanes 42 and, in turn, the front plate 38. Alternative and/or additional means of interconnecting the plates, including but not limited to the use of fasteners, adhesives, latches, or integral formation, are permissible according to some aspects of the present invention, however. Furthermore, it falls within the scope of some aspects of the present invention for the plates to be integrally formed together as part of a unitary body (e.g., in a single molding process).

The blower wheel 14 further preferably includes a hub 76. As will be discussed in greater detail below, the hub 76 at least in part receives the shaft 22.

The hub 76 is preferably an integral part of the blower wheel 14. More particularly, the hub 76 is preferably integrally formed with the front plate 38.

The shaft 22 preferably includes a driven end 78 adjacent the stator 18, a blower end 80 spaced axially from the driven end 78 and adjacent the blower wheel 14, and a main body 82 extending between and interconnecting the driven end 78 and the blower end 80.

The main body 82 is preferably secured snugly to the hub 76 via a press fit or friction fit, although other types of fit (e.g., a slip fit) are permissible according to some aspects of the present invention. As will be described, the shaft 22 and the hub 76 are further connected by additional means other than just the press fit or friction fit. That is, the hub 76 is preferably secured to the shaft 22 by multiple interconnections, including the aforementioned press fit or friction fit and additional means to be discussed below.

Figure 10:
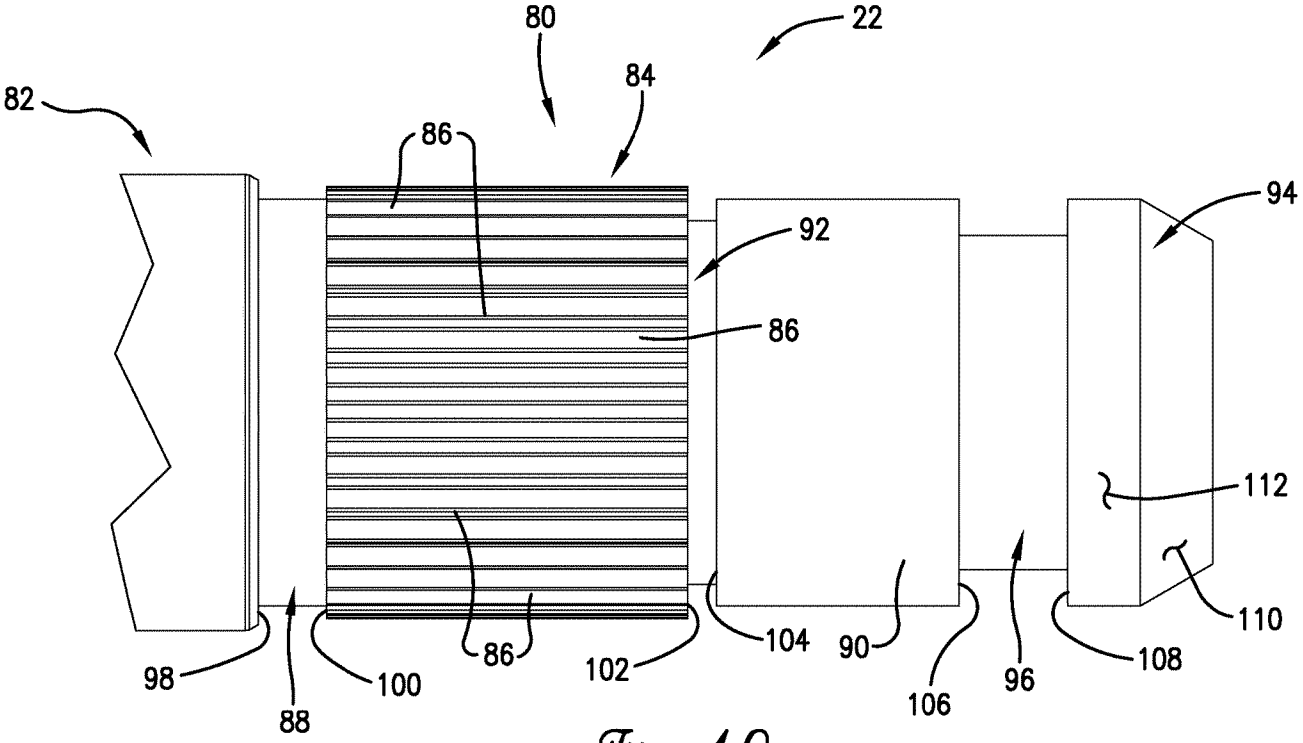
FIG. 10 is an enlarged side view of a portion of the shaft of FIGS. 1-6, 8, and 9.
Figure 11:
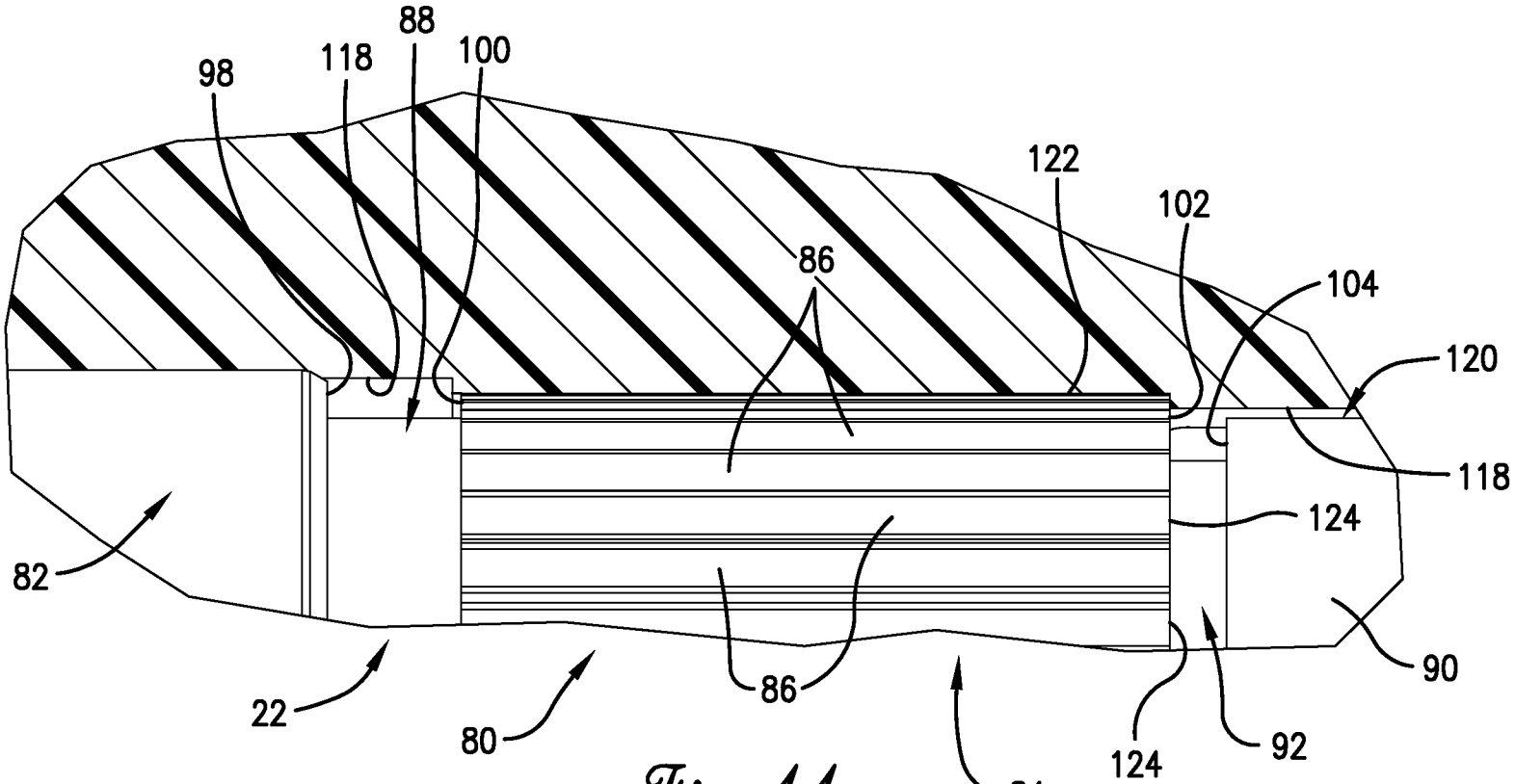
FIG. 11 is an enlarged side view of a portion of the shaft and blower wheel of FIGS. 1-6 and 8-10.

As best shown in FIG. 10, the blower end 80 preferably includes a toothed region 84 spaced axially from the main body 82 by a first circumferential recess 88. The blower end 80 further preferably includes an intermediate section 90 spaced axially from the toothed region 84 by a second circumferential recess 92. Yet further, the blower end 80 preferably includes a leading end 94 spaced axially from the intermediate section 90 by a third circumferential recess 96. The main body 82 and the toothed region 84 preferably present respective generally radially and circumferentially extending shoulders 98 and 100 in part defining the first recess 88. The toothed region 84 and the intermediate section 90 preferably present respective generally radially and circumferentially extending shoulders 102 and 104 in part defining the second recess 92. The intermediate section 90 and the leading end 94 preferably present respective generally radially and circumferentially extending shoulders 106 and 108 in part defining the third recess 96.

As will be discussed in greater detail below, the leading end 94 preferably includes a circumferentially extending first angled deflection face 110 and a circumferentially extending, generally axial slip face 112 disposed between the third recess 96 and the first angled deflection face 110.

In a preferred embodiment, the first angled deflection face 110 is oriented between about fifteen degrees (15°) and about forty-five degree (45°) relative to the axis. Most preferably, the first angled deflection face 110 is oriented about thirty degrees (30°) relative to the axis.

The first angled deflection face 110 and the slip face 112 each preferably extend continuously circumferentially, although discontinuous extension is permissible according to some aspects of the present invention.

The toothed region 84 preferably defines a plurality of arcuately spaced apart teeth 86. The teeth 86 are preferably evenly arcuately spaced apart, although uneven spacing is permissible according to some aspects of the present invention.

The teeth 86 are preferably generally axially extending, although helical or other types of extension are permissible according to some aspects of the present invention.

Figure 12:
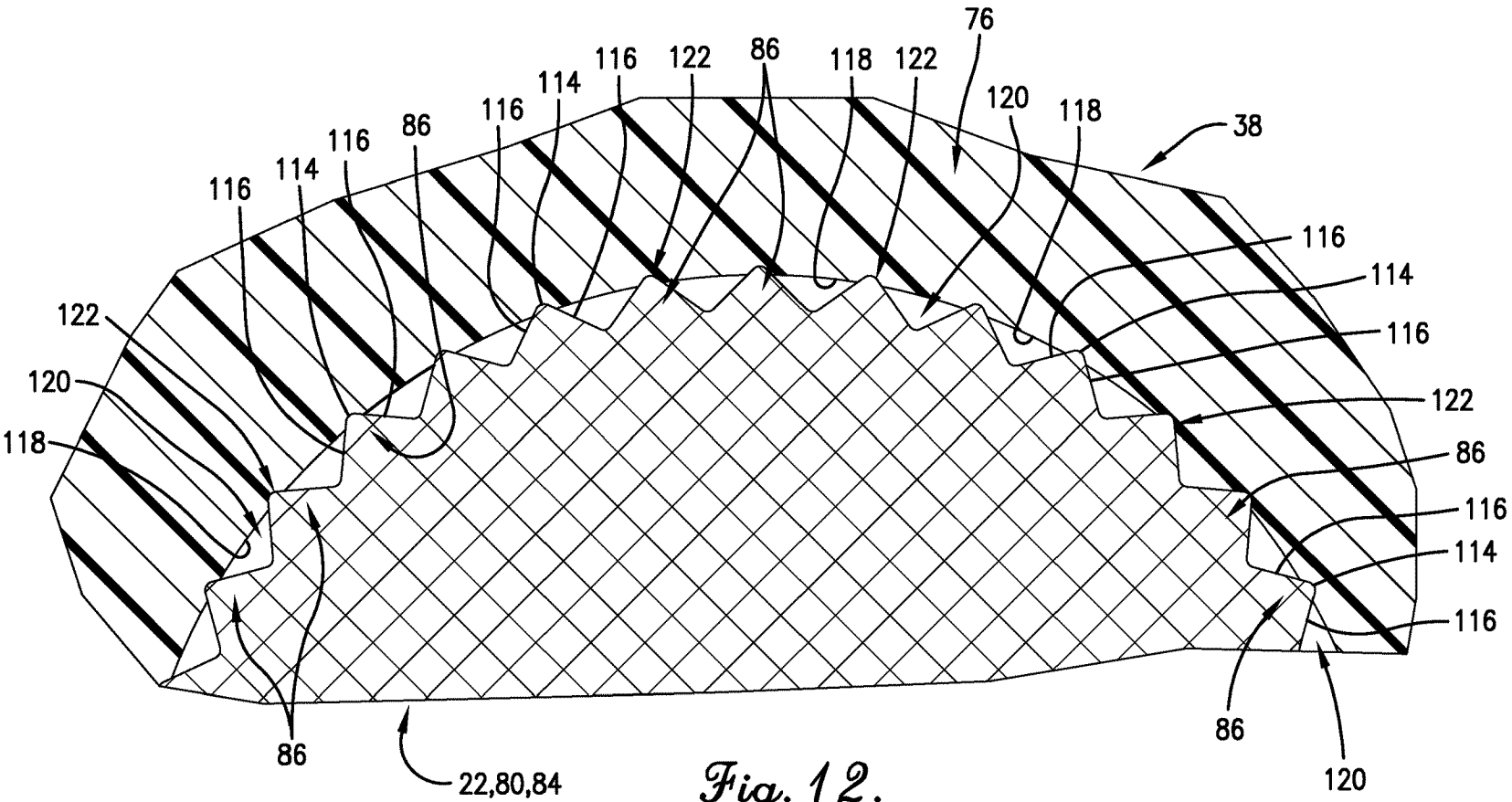
FIG. 12 is a cross-sectional front view of the shaft and a portion of the blower wheel of FIGS. 1-6 and 8-11, particularly illustrating the engagement of the shaft teeth and the blower wheel.
Figure 13:
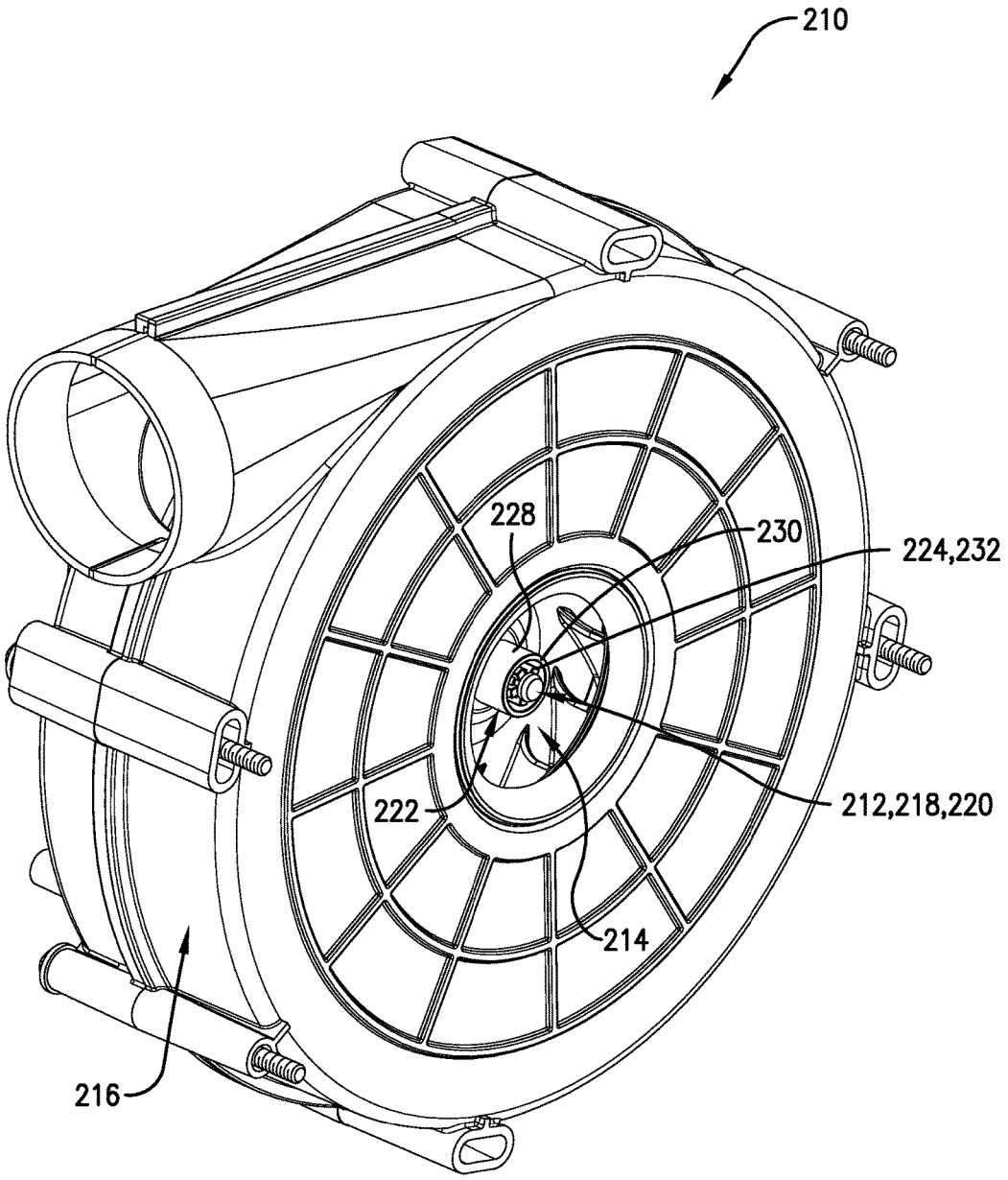
FIG. 13 is a rear perspective view of a blower motor assembly constructed in accordance with a second preferred embodiment of the present invention.
Figure 14:
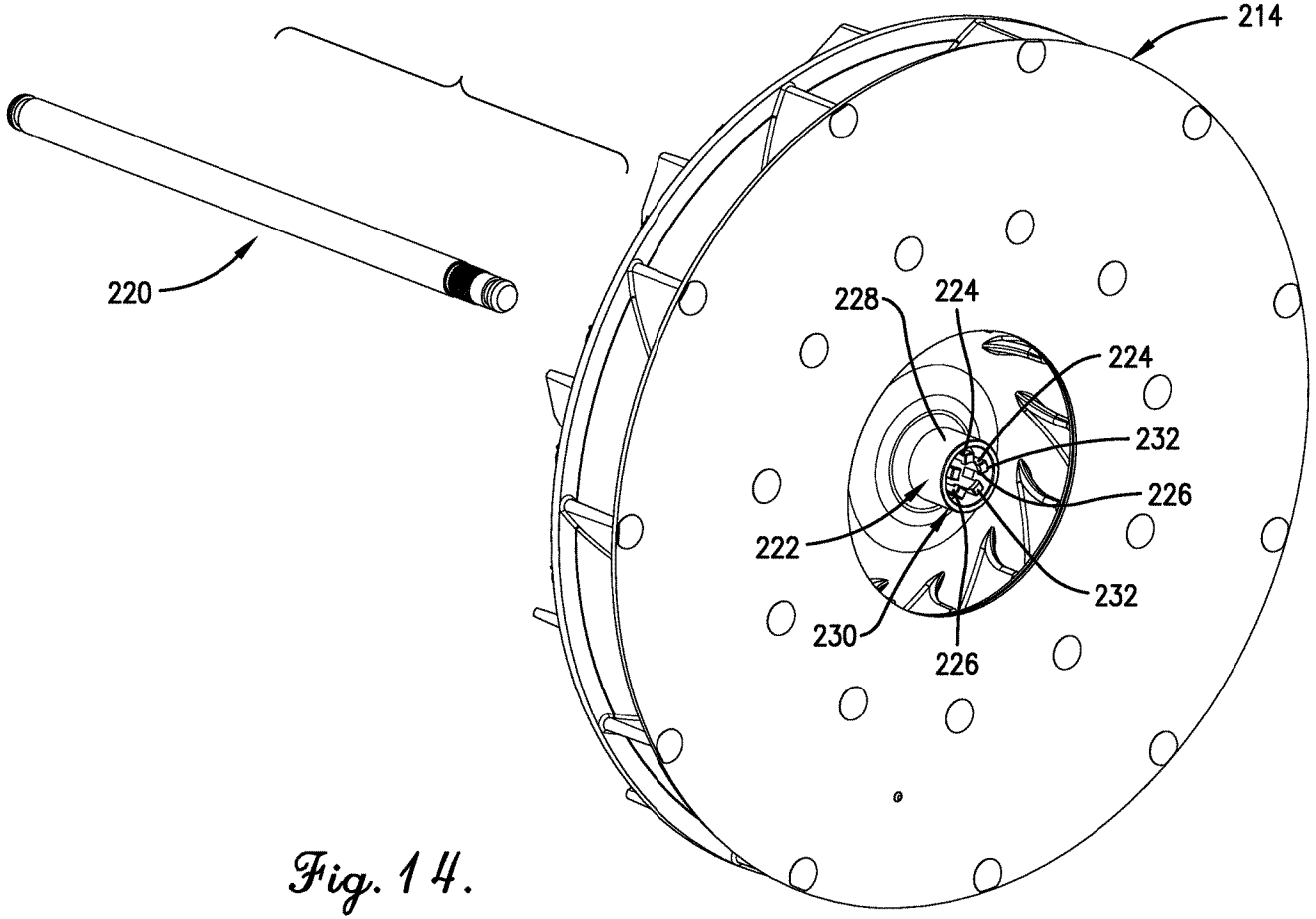
FIG. 14 is an exploded rear perspective view of the shaft and blower wheel of FIG. 13.
Figure 15:
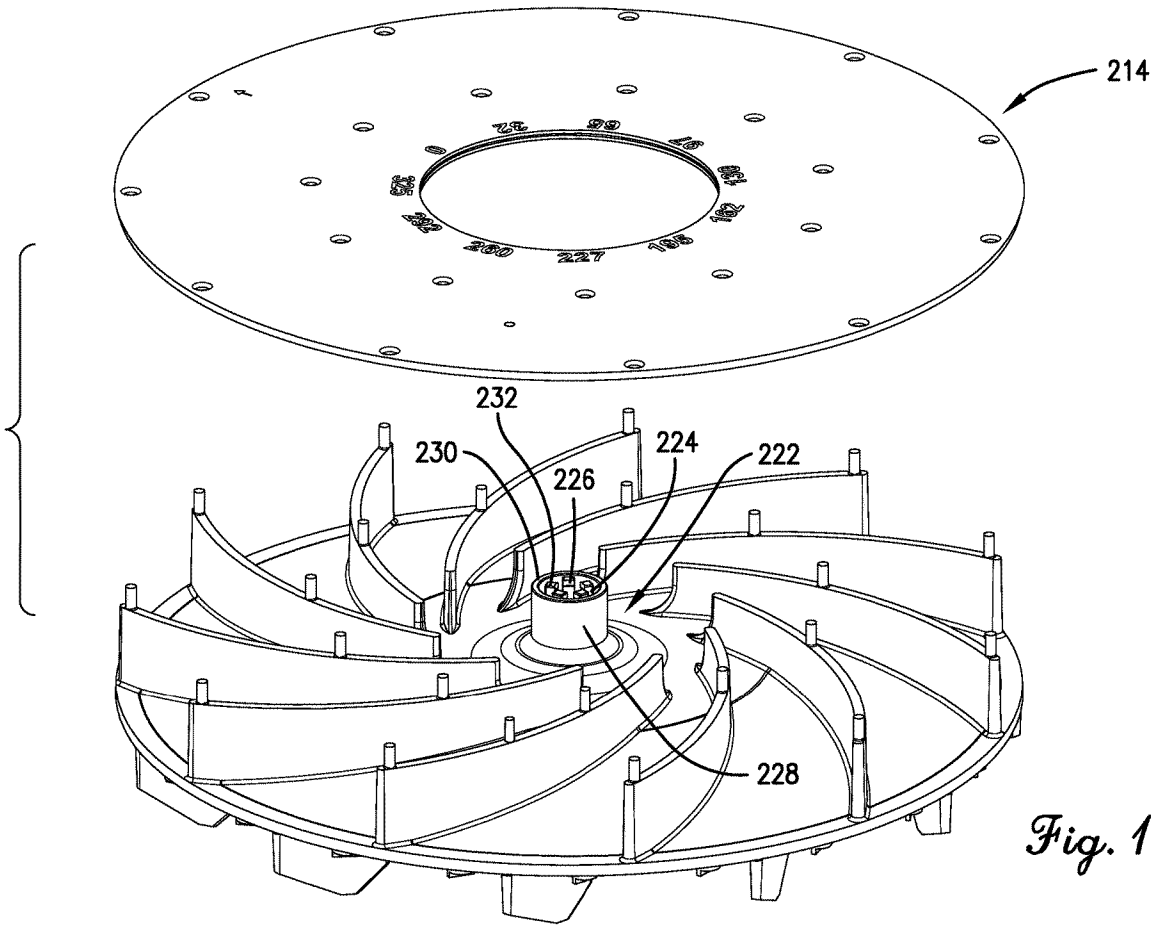
FIG. 15 is a perspective view of the blower wheel of FIGS. 13 and 14, with the rear plate elevated, particularly illustrating the positioning pegs prior to joining of the rear plate and the pegs via ultrasonic welding.
Figure 16:
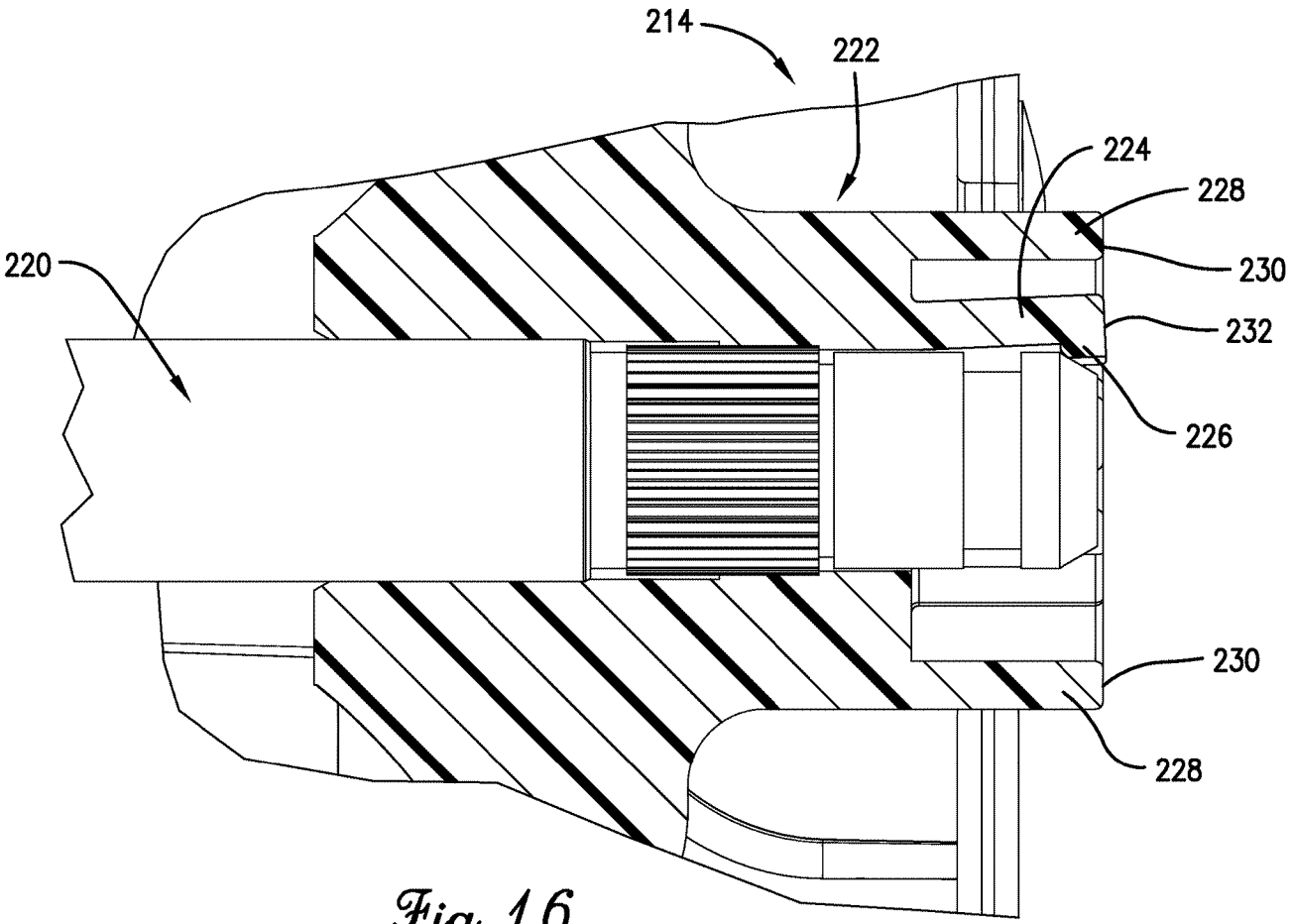
FIG. 16 is a partially sectioned side view of the shaft and blower wheel of FIGS. 13-15, particularly illustrating outward deflection of the blower wheel hub as the shaft is received in the hub opening.

As best shown in FIG. 12, each tooth 86 preferably includes an apex and a pair sides 116 extending from the apex 114. The apex 114 is preferably radiused, although a sharp or otherwise configured apex may alternatively be provided on some or all of teeth without departing from the scope of some aspects of the present invention.

The sides 116 of each tooth 86 are preferably straight and at least substantially perpendicular to each other. That is, an angle of about ninety degrees (90°) is preferably formed between each pair of sides 116 adjacent the corresponding apex 114. It is permissible according to some aspects of the present invention, however, for non-straight and/or non-perpendicular sides to be provided. For instance, the sides might be convex or concave, or the angle between respective pairs of sides might be sixty degrees (60°). Furthermore, the teeth might be in an entirely alternative form. For instance, the teeth might be in the form of splines or rectangular keys.

The teeth 86 are preferably all identically configured, although the teeth may vary in shape and/or size according to some aspects of the present invention.

As will be discussed in greater detail below, regardless of the general configuration of the teeth, it is preferable that the teeth 86 be configured in such a manner as to retain a high degree of structural integrity. That is, very narrow or otherwise non-robust teeth (i.e., teeth prone to a significant degree of deflection or other degradation during assembly of the motor assembly, as will be discussed in greater detail below) are not preferred.

The shaft 22 preferably comprises metal, although any one or more of a variety of suitable materials may be used without departing from the scope of some aspects of the present invention. More particularly, as noted previously and as will be discussed in greater detail below, specific materials are of less importance than the relative properties of the material(s) constituting certain regions of the blower wheel 14 and the shaft 22.

As noted previously, the blower wheel 14 preferably includes an integrally formed hub 76 that at least in part receives the shaft 22. More particularly, the hub 76 preferably presents a radially inner hub surface 118 that at least in part defines a hub opening 120. The shaft 22 is axially received in the hub opening 120. Most preferably, as will be discussed in greater detail below, the hub opening 120 at least substantially receives the blower end 80 and further receives a portion of the main body 82 of the shaft 22.

The hub 76 is configured such that receipt of the shaft 22, beginning with the leading end 94, causes the formation of grooves 122 in the inner hub surface 118. More particularly, each tooth 86 preferably includes a cutting edge 124 that cuts a corresponding one of the grooves 122 upon relative axial shifting of the shaft 22 and the hub 76 (e.g., by axial shifting of the shaft 22 relative to the stationary hub 76 such that the shaft 22 is received in the hub opening 120.).

In more detail, the inner hub surface 118 preferably defines a inner cross-sectional dimension. The teeth 86 preferably present an outer cross-sectional dimension that is greater than the inner cross-section dimension of the inner hub surface 118. Such interference-causing dimensional disparity is such that the cutting edges 124 of the teeth 86 cut the plurality of grooves 122 in the inner hub surface 118 as the shaft 22 is axially received in the hub opening 120.

It is noted that "cut" as used herein should be understood as referring to any mechanical means by which the pre-existing interference between parts is overcome (e.g., material removal, deformation, and/or relocation). Furthermore, "cutting edge" should be understood to be any portion enacting such cutting. For instance, while the cutting edge may comprise a sharp point or ridge, it may additionally or alternatively include a flat surface operable to push or compress an adjacent material. Such surface may be oriented in any operable manner. For instance, the surface might be oriented orthogonally relative to the axis or be angled obliquely relative thereto to form a tapered profile. In the illustrated embodiment, for instance, the cutting edge 124 of a given tooth 86 includes a generally radially extending flat surface that engages the hub 76 to push material aside for formation of the corresponding groove 122. The sides 116 of each tooth 86 direct the material and thereby constitute part of the cutting edge, as well.

Preferably, the inner cross-sectional dimension of the inner hub surface 118 is between about five thousandths (0.005) inches and fifteen thousandths (0.015) inches smaller than the outer cross-sectional dimension of the teeth 86. Most preferably, the inner cross-sectional dimension of the inner hub surface 118 is about nine thousandths (0.009) inches smaller than the outer cross-sectional dimension of the teeth 86. It is permissible according to some aspects of the invention, however, for the degree of interference to vary. For instance, variations in cutting edge configuration and/or material selection for the hub and the shaft might result in a different degree of interference being optimal.

In a preferred embodiment, the toothed region 84 has a generally circular cross-sectional shape with an outer diameter that presents the outer cross-sectional dimension. Furthermore, the inner hub surface 118 is preferably at least substantially circular in cross-section to present an inner diameter that defines the inner cross-sectional dimension.

Preferably, the inner and outer dimensions (or, more preferably, the inner and outer diameters) are axially constant, although tapering or other variations are permissible according to some aspects of the present invention.

In keeping with the preferred tooth 86 configuration described above, the grooves 122 are preferably generally axially extending and evenly arcuately spaced apart, although such preferred arrangement may vary in keeping with the above-describe permissible variations in the configuration of the teeth.

Preferably, the teeth 86 and the hub 76 comprise dissimilar materials, with the hub 76 comprising a relatively softer material conducive for cutting by the relatively harder material of the teeth. More preferably, the entire shaft 22 and the entire blower wheel 14 comprise dissimilar materials, with the blower wheel 14 comprising a relatively softer material conducive for cutting by the relatively harder material of the shaft 22. As noted above, it is preferred for the shaft 22, and particularly the teeth 86, to be formed of metal. In contrast, it is preferred for the blower wheel 14, and particularly the hub 76, to be formed of plastic.

In a preferred embodiment, the hub 76 includes a plurality of axially extending, resiliently deflectable tabs 126 and a plurality of flanges 128. Each flange 128 preferably extends generally radially inwardly from a corresponding one of the tabs 126. The tabs 126 (and, in turn, the flanges 128) are preferably evenly arcuately spaced apart, although uneven or otherwise alternative arrangements are permissible according to some aspects of the present invention.

Figure 8:
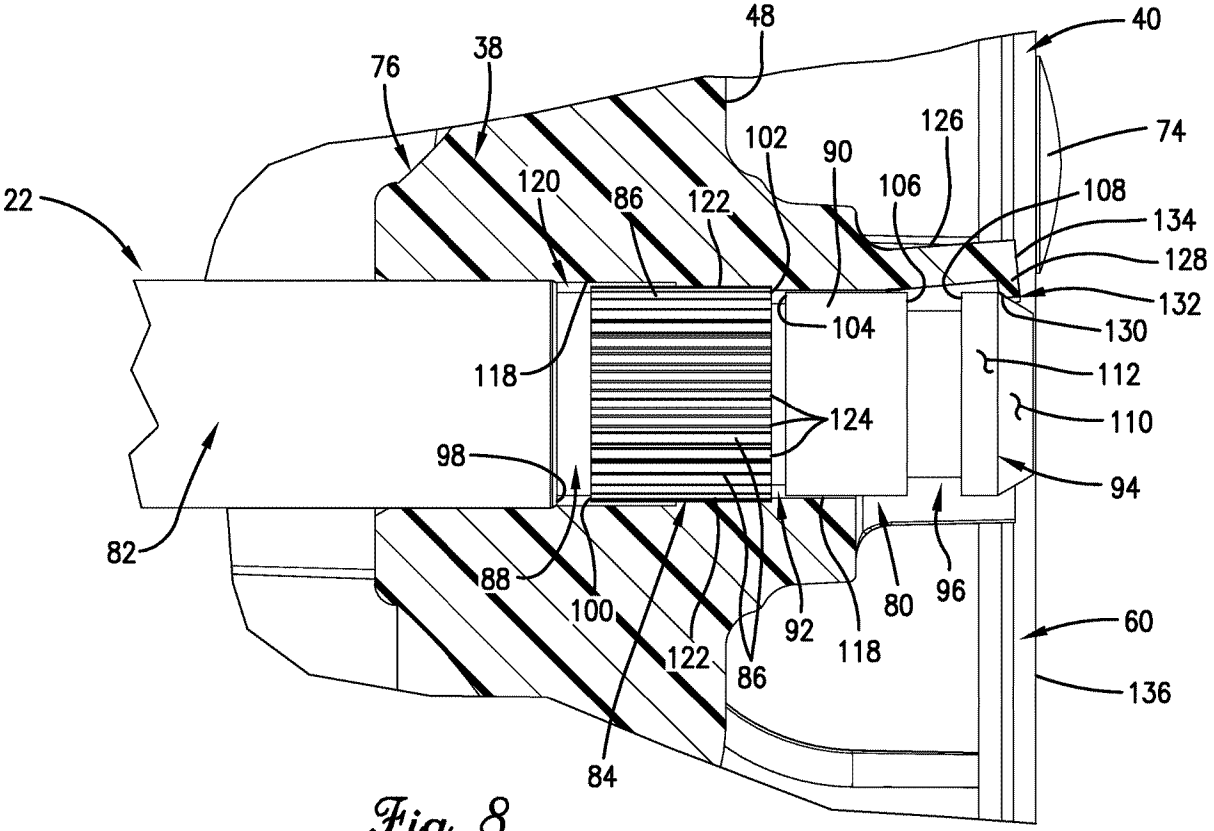
FIG. 8 is a partially sectioned side view of the shaft and blower wheel of FIGS. 4-7, particularly illustrating outward deflection of the blower wheel hub as the shaft is received in the hub opening.

The flanges 128 each preferably define a second angled deflection face 130, to be described in greater detail below. As best shown in FIG. 8, the first and second angled deflection faces 110 and 130, respectively, are preferably configured such that contact between the first angled deflection face 110 of the shaft 22 and the second angled deflection faces 130 of the flanges 128 causes radially outward deflection of the tabs 126 as the shaft 22 is axially received in the hub opening 120. That is, in the preferred embodiment, the tabs 126 resiliently deflect radially outwardly upon engagement with the shaft 22, as the shaft is axially received in the hub opening 120.

More particularly, the flanges 128 preferably cooperatively define a flange opening 132. When the tabs 126 are in an undeflected position, the flange opening 132 has an outer diameter that is smaller than that of the slip face 112 of the leading end 94. That is, the slip face 112 cannot pass through the flange opening 132 unless the flange opening 132 is expanded. Such resilient expansion is illustrated in FIG. 8, in which the first and second angled deflection faces 110 and 130, respectively, engage each other while the shaft 22 is shifted axially relative to the hub 76. This engagement causes the tabs 126 to resiliently deflect radially outwardly, which in turn shifts the flanges 128 radially outward and expands the flange opening 132.

Figure 9:
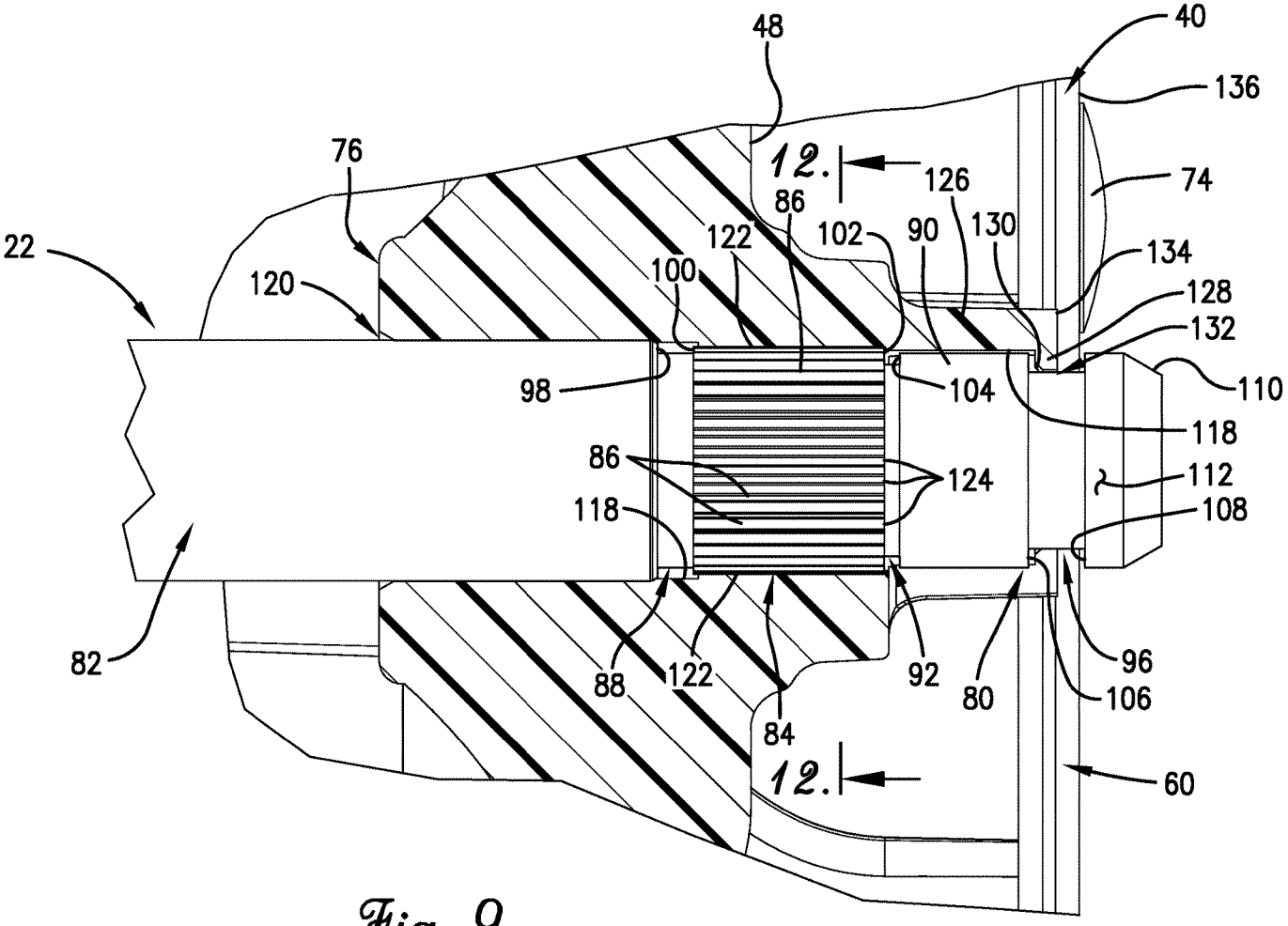
FIG. 9 is a partially sectioned side view of the shaft and blower wheel of FIGS. 4-8, particularly illustrating shaft positioning after insertion within the blower wheel hub is complete.

As noted previously, the first angled deflection face 110 is preferably oriented between about fifteen degrees (15°) and about forty-five degree (45°) relative to the axis. Most preferably, the first angled deflection face 110 is oriented about thirty degrees (30°) relative to the axis. The second angled deflection face 130 is preferably oriented between about thirty degrees (30°) and about sixty degrees (60°) relative to the axis. Most preferably, the second angled deflection face 130 is oriented about forty-five degrees (45°) relative to the axis As best shown in FIG. 9, the flanges 128 extend radially inwardly into the third recess 96 after the leading end 94 has passed through the flange opening 132. That is, the tabs 126 and, in turn, the flanges 128, return to their original, non-deflected state upon clearance of the slip face 112 through the flange opening 132.

Alternatively, the tabs and flanges may be configured such that the tabs remain resiliently flexed when the flanges are received in the recess, with the tabs thereby providing a generally radially inward compressive force that aids the flanges in "gripping" the shaft.

Upon receipt of the flanges 128 in the third recess 96, the flanges 128 and the shoulders 106 and 108 preferably cooperatively restrict relative axial movement between the hub 76 and the shaft 22.

Although it is preferred that the third recess 96 is in part defined by a pair of shoulders 106 and 108, with the two shoulders 106 and 108 cooperatively restricting movement of the hub 76 and shaft 22 as described above, it is permissible according to some aspects of the present invention for only one of the shoulders to restrict such motion and/or for the third recess to be associated with only one shoulder. For instance, in an alternative embodiment, only an inward-facing shoulder (e.g., the shoulder 108) might be provided, with the inward-facing shoulder cooperating with the flanges to prevent the blower wheel from shifting off the blower end of the shaft. However, an additional outward-facing shoulder (e.g., the shoulder 106) is most preferably provided, so that axial movement of the wheel relative to the shaft is limited in both axial directions.

In a preferred embodiment, as best shown in FIG. 9, each tab 126 extends axially so as to present an endmost margin 134 that is generally flush with or, alternatively, slightly recessed relative to an outermost axial margin 136 of the rear plate 40. The rear plate 40 therefore to at least some extent protects against physical damage to the tabs 126 and the flanges 128. As will be discussed in greater detail below, however, alternative degrees of axial extension are permissible without departing from the scope of some aspects of the present invention. Furthermore, it is permissible according to some aspects of the present invention for variations in axial extension to occur amongst the tabs. Such variations would preferably be accompanied by corresponding changes to the configuration of the third recess, however, to ensure the functionality of the flanges and associated structures is retained.

Thus, as will be apparent from the above description, it is most preferable that the shaft 22 and the blower wheel 14 are interconnected by three (3) primary means: the tight fit (e.g., press fit or friction fit) of the main body 82 of the shaft 22 in the hub opening 120; the engagement of the teeth 86 of the shaft 22 with the grooves 122 (formed in the hub 76 by means of the cutting edges 124 of the teeth 86); and the locking effect of the tabs 126 and the flanges 128, particularly in cooperation with the shoulders 106 and 108.

A second preferred blower motor assembly 210 is illustrated in FIGS. 13-17. It is initially noted that, with certain exceptions to be discussed in detail below, many of the elements of the blower motor assembly 210 of the second embodiment are the same as or very similar to those described in detail above in relation to the blower motor assembly 10 of the first embodiment. Therefore, for the sake of brevity and clarity, redundant descriptions and numbering will be generally avoided here. Unless otherwise specified, the detailed descriptions of the elements presented above with respect to the first embodiment should therefore be understood to apply at least generally to the second embodiment, as well.

The blower motor assembly 210 of the second embodiment preferably includes a blower motor 212, a blower wheel 214, and a housing 216. The blower motor 212 preferably includes a stator (not shown) and a rotor 218 rotatable about an axis. The rotor 218 preferably includes a shaft 220 rotatably supporting the blower wheel 214.

The blower wheel 214 preferably includes an integrally formed hub 222 that at least in part receives the shaft 220. The hub 222 preferably includes a plurality of axially extending, resiliently deflectable tabs 224 and a plurality of flanges 226. Each flange 226 preferably extends generally radially inwardly from a corresponding one of the tabs 224.

The hub 222 further preferably includes an axially projecting collar 228 extending about the tabs 224 and the flanges 226. Preferably, the collar 228 comprises a circumferential wall that at least substantially circumscribes the tabs 224 and the flanges 226. However, alternative shapes are permissible. For instance, the collar might instead form a rectangle about the flanges and tabs.

The collar 228 preferably extends continuously circumferentially, although discontinuous extension is permissible according to some aspects of the present invention.

Figure 17:
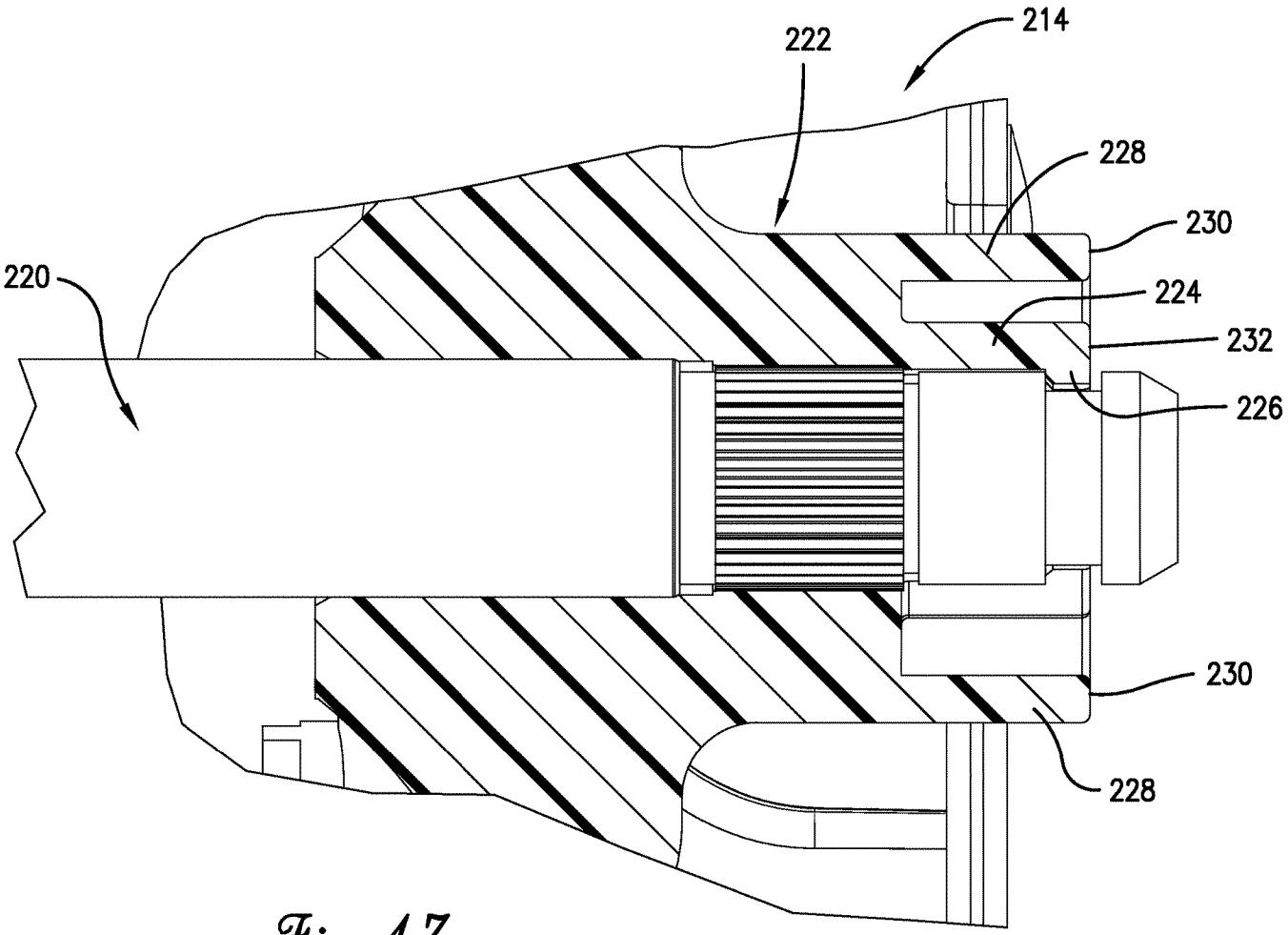
FIG. 17 is a partially sectioned side view of the shaft and blower wheel of FIGS. 13-16, particularly illustrating shaft positioning after insertion within the blower wheel hub is complete.

In a preferred embodiment, as best shown in FIG. 17, the collar 228 extends axially so as to present an endmost margin 230. Similarly, each tab 224 presents an axially endmost margin 232. The endmost margin 230 of the collar 228 is preferably flush with the endmost margins 232 of the tabs 224. The collar 228 thereby preferably protects against damage to the tabs 224 and the flanges 226.

Although a generally flush configuration is preferred, the collar may alternatively extend axially past the endmost margins of the tabs or be recessed relative to the endmost margins. Preferably, however, the collar provides at least some degree of structural protection to the tabs and/or the flanges.

The preferred forms of the invention described above are to be used as illustration only and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby states their intent to rely on the Doctrine of Equivalents to determine and assess the reasonably fair scope of the present invention as pertains to any apparatus not materially departing from but outside the literal scope of the invention set forth in the following claims.

What is claimed is:

1. A blower motor assembly for use in a machine, said motor assembly comprising:

a blower wheel including a hub, said hub being an integral part of said blower wheel, said hub presenting a radially inner hub surface that at least in part defines a hub opening, said inner hub surface defining an inner cross-sectional dimension; and a motor including a shaft rotatable about an axis, said shaft being axially received within the hub opening, such that the blower wheel is supported by the shaft for rotational movement, said shaft including a toothed region defining a plurality of arcuately spaced apart teeth, each of said teeth including a cutting edge, said teeth presenting an outer cross-sectional dimension that is greater than the inner cross-sectional dimension of the inner hub surface, such that the cutting edges of the teeth cut a plurality of grooves in the inner hub surface as the shaft is axially received in the hub opening, said shaft including a pair of radially extending shoulders at least in part defining a circumferentially extending recess therebetween, said hub including a flange extending radially inwardly into the recess, said flange and said shoulders restricting relative axial movement between the hub and the shaft, said hub including an axially extending, resiliently deflectable tab, said flange extending from said tab, said tab being configured to deflect radially outwardly upon engagement with the shaft, as the shaft is axially received in the hub opening.

2. The blower motor assembly as claimed in claim 1, said toothed portion having a generally circular cross-sectional shape with an outer diameter that presents the outer cross-sectional dimension, said inner hub surface being at least substantially circular in cross-section to present an inner diameter that defines the inner cross-sectional dimension.

3. The blower motor assembly as claimed in claim 2, said teeth and grooves extending axially, said inner and outer diameters each being axially constant.

4. The blower motor assembly as claimed in claim 3, said inner diameter being about 0.009 inches smaller than the outer diameter.

5. The blower motor assembly as claimed in claim 1, said shaft and said blower wheel comprising dissimilar materials.

6. The blower motor assembly as claimed in claim 5, said shaft comprising metal, said blower wheel comprising plastic.

7. The blower motor assembly as claimed in claim 1, said shaft including a main body secured to the hub via a friction fit.

8. The blower motor assembly as claimed in claim 1, said hub including a plurality of the flanges and tabs, with each flange and corresponding tab being arcuately spaced apart from at least one other flange and corresponding tab.

9. The blower motor as claimed in claim 1, said hub including a collar extending about said flanges and tabs.

10. The blower motor assembly as claimed in claim 1, said shaft having a leading end defining a first angled deflection face, said flange defining a second angled deflection face, said deflection faces being configured such that contact therebetween causes deflection of the tab, as the shaft is axially received in the hub opening.

11. The blower motor assembly as claimed in claim 10, said first deflection face being oriented 30 degrees relative to the axis, said second deflection face being oriented 45 degrees relative to the axis.

12. The blower motor assembly as claimed in claim 10, said deflection facing being configured to deflect the tab radially outwardly, as the shaft is axially received in the hub opening.

13. The blower motor assembly as claimed in claim 1, each of said teeth having an apex and a pair sides extending from the apex.

14. The blower motor assembly as claimed in claim 13, said sides being straight.

15. The blower motor assembly as claimed in claim 14, said sides being perpendicular to one another.

16. The blower motor assembly as claimed in claim 13, said apex being radiused.

17. The blower motor assembly as claimed in claim 1, said blower wheel including— a generally radially extending plate extending from the hub, and a plurality of arcuately spaced apart, generally radially extending vanes projecting axially from the plate.

18. The blower motor assembly as claimed in claim 17, said blower wheel being a draft inducer blower wheel.

19. The blower motor assembly as claimed in claim 17, said hub and said plate being integrally molded with one another.

* * * * *